US007897548B2

(12) United States Patent
Lam et al.

(10) Patent No.: US 7,897,548 B2
(45) Date of Patent: Mar. 1, 2011

(54) ADDITIVES AND LUBRICANT FORMULATIONS FOR IMPROVED ANTIWEAR PROPERTIES

(75) Inventors: William Y. Lam, Glen Allen, VA (US); Mark T. Devlin, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 978 days.

(21) Appl. No.: 11/686,547

(22) Filed: Mar. 15, 2007

(65) Prior Publication Data

US 2008/0223330 A1 Sep. 18, 2008

(51) Int. Cl.
*C10M 129/26* (2006.01)
*C10M 125/00* (2006.01)
*C10M 159/22* (2006.01)
*C10M 159/24* (2006.01)

(52) U.S. Cl. ..... 508/165; 508/418; 508/391; 123/1 A

(58) Field of Classification Search ..... 508/363, 508/165, 491, 318; 123/1 A
See application file for complete search history.

(56) References Cited

U.S. PATENT DOCUMENTS

| | | | | |
|---|---|---|---|---|
| 2,719,125 | A | 9/1955 | Roberts | |
| 2,719,126 | A | 9/1955 | Fields et al. | |
| 2,995,569 | A | 8/1961 | Hamilton et al. | |
| 3,087,932 | A | 4/1963 | Little, Jr. | |
| 3,219,666 | A | 11/1965 | Norman et al. | |
| 3,565,804 | A | 2/1971 | Honnen et al. | |
| 3,673,090 | A | 6/1972 | Waldbillig et al. | |
| 3,697,574 | A | 10/1972 | Piasek et al. | |
| 3,703,504 | A | 11/1972 | Horodysky | |
| 3,703,505 | A | 11/1972 | Horodysky et al. | |
| 3,736,357 | A | 5/1973 | Piasek et al. | |
| 3,796,661 | A | 3/1974 | Suratwala et al. | |
| 3,821,236 | A | 6/1974 | Ripple | |
| 3,873,454 | A | 3/1975 | Horodysky et al. | |
| 3,904,537 | A | 9/1975 | Ripple | |
| 4,097,387 | A | 6/1978 | Caspari | |
| 4,107,059 | A | 8/1978 | King et al. | |
| 4,136,043 | A | 1/1979 | Davis | |
| 4,137,183 | A | 1/1979 | Caspari | |
| 4,188,299 | A | 2/1980 | Caspari | |
| 4,193,882 | A | 3/1980 | Gemmill, Jr. | |
| 4,234,435 | A | 11/1980 | Meinhardt et al. | |
| 4,636,322 | A | 1/1987 | Nalesnik | |
| 4,654,156 | A | 3/1987 | Horodysky et al. | |
| 4,702,850 | A | 10/1987 | Gutierrez et al. | |
| 4,857,214 | A | 8/1989 | Papay et al. | |
| 4,867,890 | A | 9/1989 | Colclough et al. | |
| 4,904,401 | A | 2/1990 | Ripple et al. | |
| 4,957,649 | A | 9/1990 | Ripple et al. | |
| 5,204,012 | A | 4/1993 | Schaffhausen | |
| 5,242,613 | A | 9/1993 | Ozbalik et al. | |
| 5,260,466 | A | 11/1993 | McGibbon | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,034,040 | A | 3/2000 | Ozbalik et al. | |
| 6,096,691 | A | 8/2000 | Conary et al. | |
| 6,114,288 | A | 9/2000 | Fujitsu et al. | |
| 7,615,519 | B2 * | 11/2009 | Esche et al. | 508/165 |
| 2006/0014651 | A1 * | 1/2006 | Esche et al. | 508/162 |
| 2006/0205615 | A1 | 9/2006 | Esche | |
| 2006/0217271 | A1 * | 9/2006 | Brown et al. | 508/165 |
| 2007/0132274 | A1 | 6/2007 | Lam et al. | |
| 2008/0020955 | A1 * | 1/2008 | Diggs et al. | 508/391 |

FOREIGN PATENT DOCUMENTS

| | | | |
|---|---|---|---|
| EP | 330522 | B1 | 8/1989 |
| JP | 61-111397 | | 5/1986 |
| JP | 03190997 | A1 | 8/1991 |
| JP | 10259392 | A1 | 9/1998 |
| JP | 11131084 | A1 | 5/1999 |
| JP | 2002-302691 | | 10/2002 |

OTHER PUBLICATIONS

Dupont Tyzor Organic Titanates General Brochure, 2001, pp. 5-6.*

* cited by examiner

*Primary Examiner*—Glenn Caldarola
*Assistant Examiner*—Jim Goloboy
(74) *Attorney, Agent, or Firm*—Luedeka, Neely & Graham, P.C.

(57) ABSTRACT

A lubricated surface, a method for reducing wear between moving parts, and lubricants, and lubricant additive concentrates containing a wear reducing agent. The lubricated surface contains a base oil of lubricating viscosity, a hydrocarbon soluble titanium compound, a metal-free friction modifier and an amount of at least one hydrocarbon soluble magnesium compound effective to provide a reduction in surface wear greater than a reduction surface wear for a lubricant composition devoid of the titanium compound, metal-free friction modifier, and magnesium compound. The lubricant composition contains no more than about 800 ppm phosphorus and is devoid of calcium detergents and organic molybdenum compound.

41 Claims, No Drawings

ADDITIVES AND LUBRICANT FORMULATIONS FOR IMPROVED ANTIWEAR PROPERTIES

TECHNICAL FIELD

The embodiments described herein relate to additive combinations of hydrocarbon soluble titanium and magnesium additives and use of such titanium and magnesium additives in lubricating oil formulations to improve antiwear properties of the lubricant formulations, particularly formulation containing reduced amounts of phosphorus containing additives.

BACKGROUND AND SUMMARY

The next generation of passenger car motor oil and heavy duty diesel engine oil categories will require equivalent antiwear properties but with lower levels of phosphorus and sulfur in the formulations in order to reduce contamination of more stringent pollution control devices. It is well known that sulfur and phosphorus containing additives impart antiwear properties to a finished oil, and also may poison or otherwise reduce the effectiveness of pollution control devices.

Zinc dialkyl dithiophosphates ("Zn DDPs") have been used in lubricating oils for many years. Zn DDPs also have good antiwear properties and have been used to pass cam wear tests, such as the Seq IVA and TU3 Wear Test. Many patents address the manufacture and use of Zn DDPs including U.S. Pat. Nos. 4,904,401; 4,957,649; 6,114,288, all of which are incorporated herein by reference in their entirety.

Sulfur-containing antiwear are also well known and include dihydrocarbyl polysulfides; sulfurized olefins; sulfurized fatty acid esters of both natural and synthetic origins; trithiones; sulfurized thienyl derivatives; sulfurized terpenes; sulfurized polyenes; sulfurized Diels-Alder adducts, etc. Specific examples include sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfides such as mixtures of di-tert-butyl trisulfide, di-tert-butyl tetrasulfide and di-tert-butyl pentasulfide, among others. Of the foregoing, sulfurized olefins are used in many applications. Methods of preparing sulfurized olefins are described in U.S. Pat. Nos. 2,995,569; 3,673,090; 3,703,504; 3,703,505; 3,796,661; and 3,873,454. Also useful are the sulfurized olefin derivatives described in U.S. Pat. No. 4,654,156. Other sulfur-containing antiwear agents are described in U.S. Pat. Nos. 4,857,214, 5,242,613, and 6,096,691.

A need exists for a lubricating additive that provides excellent antiwear properties and is more compatible with pollution control devices used for automotive and diesel engines.

In view of the foregoing, exemplary embodiments disclosed herein provide a lubricated surface, a method for reducing wear between moving parts, and lubricants, and lubricant additive concentrates containing a wear reducing agent. The lubricated surface contains a base oil of lubricating viscosity, a hydrocarbon soluble titanium compound, a metal-free friction modifier, and an amount of at least one hydrocarbon soluble magnesium compound effective to provide a reduction in surface wear greater than a reduction surface wear for a lubricant composition devoid of the titanium compound, metal-free friction modifier, and magnesium compound. The lubricant composition contains no more than about 800 ppm phosphorus and is devoid of calcium detergents and organic molybdenum compounds.

In one exemplary embodiment, there is provided a vehicle having moving parts wherein the vehicle contains a lubricant for lubricating the moving parts. The lubricant is an oil of lubricating viscosity and an amount of antiwear agent providing a combination of a hydrocarbon soluble titanium compound, metal-free friction modifier, and at least one hydrocarbon soluble magnesium compound effective to provide a reduction in surface wear of the moving parts greater than a reduction surface wear of the moving parts for a lubricant composition devoid of the titanium compound, metal-free friction modifier, and magnesium compound. The lubricant composition contains no more than about 800 ppm phosphorus and is devoid of calcium detergents and organic molybdenum compounds.

In yet another embodiment there is provided a fully formulated lubricant composition include a base oil component of lubricating viscosity and an amount of antiwear agent provided by a combination of a hydrocarbon soluble titanium-containing compound, a metal-free friction modifier, and at least one hydrocarbon soluble magnesium compound effective to provide wear reduction greater than an amount of wear reduction for a lubricant composition devoid of the combination of titanium, metal-free friction modifier, and magnesium compound. The lubricant composition contains no more than about 800 ppm phosphorus and is devoid of calcium detergents and organic molybdenum compounds.

A further embodiment of the disclosure provides a lubricant additive concentrate for providing improved antiwear properties to a lubricant composition. The concentrate is substantially devoid of calcium and molybdenum and includes a hydrocarbyl carrier fluid and a synergistic amount of a combination of a hydrocarbon soluble titanium compound, a metal-free friction modifier, and a hydrocarbon soluble magnesium compound sufficient to provide from about 10 to about 500 ppm titanium and from about 120 to about 2000 ppm magnesium to a lubricant composition containing the concentrate.

As set forth briefly above, embodiments of the disclosure provide an antiwear additive including a combination of a hydrocarbon soluble titanium compound, a metal free-friction modifier, and a hydrocarbon soluble magnesium compound that may significantly improve the antiwear performance of a lubricant composition thereby enabling a decrease in the amount of phosphorus and sulfur antiwear additives required for equivalent antiwear performance. The additive may be mixed with an oleaginous fluid that is applied to a surface to reduce surface wear. In other applications, the additive may be provided in a fully formulated lubricant composition. The additive is particularly directed to meeting the currently proposed GF-4 standards for passenger car motor oils and PC-10 standards for heavy duty diesel engine oil.

The compositions and methods described herein are particularly suitable for reducing contamination of pollution control devices on motor vehicles or, in the alternative, the compositions are suitable for improving the performance of antiwear agents in lubricant formulations. Other features and advantages of the compositions and methods described herein may be evident by reference to the following detailed description which is intended to exemplify aspects of the disclosed embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a combination of a magnesium compound, a titanium compound, and a metal-free friction modifier that is useful as a component in lubricating oil compositions. The magnesium compound comprises a hydrocarbon soluble magnesium compound selected from the group consisting of magnesium sulfonates, magnesium phenates, magnesium salicylates, and mixture thereof.

The term "hydrocarbon soluble" means that the compound is substantially suspended or dissolved in a hydrocarbon material, as by reaction or complexation of a magnesium compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(ii) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(iii) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, typically no more than one, non-hydrocarbon substituent will be present for every ten carbon atoms in the hydrocarbyl group; typically, there will be no non-hydrocarbon substituents in the hydrocarbyl group.

The magnesium compound is desirably a basic or overbased magnesium salt that contains an excess of the magnesium cation. Generally, the basic or overbased salts will have metal ratios of up to about 40 and more particularly will have a metal ratio of about 2 to about 30 or 40.

A commonly employed method for preparing the basic (or overbased) magnesium salts comprises heating a mineral oil solution of an acid with a stoichiometric excess of a metal neutralizing agent, e.g., a metal oxide, hydroxide, carbonate, bicarbonate, sulfide, etc., at temperatures above about 50° C. In addition, various promoters may be used in the overbasing process to aid in the incorporation of the large excess of metal. These promoters include such compounds as the phenolic substances, e.g., phenol, naphthol, alkylphenol, thiophenol, sulfurized alkylphenol and the various condensation products of formaldehyde with a phenolic substance; alcohols such as methanol, 2-propanol, octyl alcohol, cellosolve carbitol, ethylene, glycol, stearyl alcohol, and cyclohexyl alcohol; amines such as aniline, phenylenediamine, phenothiazine, phenyl-beta-naphthylamine, and dodecyl amine, etc.

The acidic organic compound from which the magnesium salt is derived may be at least one sulfur acid, carboxylic acid, phosphorus acid, or phenol or mixtures thereof. The sulfur acids may be sulfonic acids, thiosulfonic, sulfinic, sulfenic, partial ester sulfuric, sulfurous and thiosulfuric acids. Sulfonic acids are particularly desirable for use in making the hydrocarbon soluble magnesium compounds.

The sulfonic acids which are useful in preparing component (B) include those represented by the formulae $$R_xT(SO_3H)_y \quad \text{(I)}$$

and $$R^1(SO_3H)_y \quad \text{(II)}$$

In these formulae, $R^1$ is an aliphatic or aliphatic-substituted cycloaliphatic hydrocarbon or essentially hydrocarbon group free from acetylenic unsaturation and containing up to about 60 carbon atoms. When $R^1$ is aliphatic, it usually contains at least about 15 carbon atoms; when it is an aliphatic-substituted cycloaliphatic group, the aliphatic substituents usually contain a total of at least about 12 carbon atoms. Examples of $R^1$ are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2-8 carbon atoms per olefinic monomer unit. $R^1$ may also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula I is generally a hydrocarbon or essentially hydrocarbon group free from acetylenic unsaturation and containing from about 4 to about 60 aliphatic carbon atoms, for example, an aliphatic hydrocarbon group such as alkyl or alkenyl. The compound may also, however, contain substituents or interrupting groups such as those enumerated above provided the essentially hydrocarbon character thereof is retained. In general, any non-carbon atoms present in $R^1$ or R do not account for more than 10% of the total weight thereof.

In the above formulas, T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x in the above formulas is at least 1 and is generally 1-3. The subscripts r and y have an average value of about 1-2 per molecule and are generally 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing hydrocarbon soluble magnesium compounds described herein. Such sulfonic acids include, but are not limited to, mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene that have been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates described herein.

Suitable carboxylic acids from which the hydrocarbon soluble magnesium compounds may be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and desirably from about 12 to about 25 carbon atoms. The cycloaliphatic and aliphatic carboxylic acids are particularly suitable, and they may be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyl-octahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The hydrocarbon soluble magnesium compound may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Phenols containing at least one alkyl substituent containing about 3-100 and especially about 6-50 carbon atoms, such as heptylphenol, octylphenol, dodecylphenol, tetrapropene-alkylated phenol, octadecylphenol and polybutenylphenols are particularly suitable. Phenols containing more than one alkyl substituent may also be used, but the monoalkylphenols are more suitable because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, methyl formcel, and paraldehyde.

The amount of hydrocarbon soluble magnesium compound included in the lubricants of the exemplary embodiments also may be varied, and useful amounts in any particular lubricating oil composition may be readily determined by one skilled in the art. The amount of the magnesium compound contained in a lubricant described herein may vary from about 0.15% to about 2.0% or more by weight based on the total weight of the lubricant. The amount of magnesium compound included in the oil composition is an amount which is sufficient to provide the desired wear inhibiting properties.

For the lubricating oil compositions disclosed herein, any suitable hydrocarbon-soluble titanium compound having friction modifying and/or extreme pressure, and/or antioxidant, and/or anti-wear properties in lubricating oil compositions may be used.

The hydrocarbon soluble titanium compounds suitable for use as a herein, for example as a wear reducing agent, friction modifier, extreme pressure agent, or antioxidant are provided by a reaction product of a titanium alkoxide and an about $C_6$ to about $C_{25}$ carboxylic acid. The reaction product may be represented by the following formula:

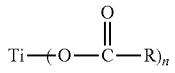

wherein n is an integer selected from 2, 3 and 4, and R is a hydrocarbyl group containing from about 5 to about 24 carbon atoms, or by the formula:

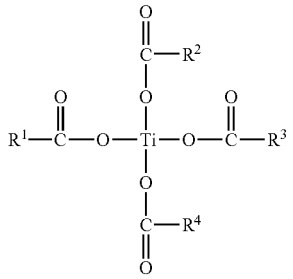

wherein each of $R^1$, $R^2$, $R^3$, and $R^4$ are the same or different and are selected from a hydrocarbyl group containing from about 5 to about 25 carbon atoms. Compounds of the foregoing formulas are essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt % or less sulfur and about 0.12 wt % or less phosphorus.

In another embodiment, the hydrocarbon soluble titanium compound may be substantially free of active sulfur. "Active"

sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment, the hydrocarbon soluble titanium compound may be substantially free of all phosphorus. In a still further embodiment, the hydrocarbon soluble titanium compound may be substantially free of all sulfur and phosphorus. For example, the base oil in which the titanium compound may be dissolved in may contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited in the base oil to an amount which permits the finished oil to meet the appropriate motor oil sulfur and/or phosphorus specifications in effect at a given time.

Examples of titanium/carboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466, the disclosure of which is incorporated herein by reference.

The following examples are given for the purpose of exemplifying aspects of the embodiments and are not intended to limit the embodiments in any way.

EXAMPLE 1

Synthesis of Reaction Product of Titanium Isopropoxide Neodecanoic Acid

Neodecanoic acid (about 600 grams) was placed into a reaction vessel equipped with a condenser, Dean-Stark trap, thermometer, thermocouple, and a gas inlet. Nitrogen gas was bubbled into the acid. Titanium isopropoxide (about 245 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 14.3 cSt at about 100° C. and a titanium content of about 6.4 percent by weight.

EXAMPLE 2

Synthesis of Reaction Product of Titanium Isopropoxide and Oleic Acid

Oleic acid (about 489 grams) was placed into a reaction vessel equipped with a condenser, Dean-Stark trap, thermometer, thermocouple, and a gas inlet. Nitrogen gas was bubbled into the acid. Titanium isopropoxide (about 122.7 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 7.0 cSt at about 100° C. and a titanium content of about 3.8 percent by weight.

The hydrocarbon soluble titanium compounds of the embodiments described herein are advantageously incorporated into lubricating compositions. Accordingly, the hydrocarbon soluble titanium compounds may be added directly to the lubricating oil composition. In one embodiment, however, hydrocarbon soluble titanium compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a metal additive concentrate. The titanium additive concentrates usually contain from about 0% to about 99% by weight diluent oil.

The lubricating compositions of the disclosed embodiment contain the titanium compound in an amount providing the compositions with at least 10 ppm of titanium. An amount of at least 10 ppm of titanium from a titanium compound has been found to be effective to provide friction modification alone or in combination with a second friction modifier selected from nitrogen containing friction modifiers; organic polysulfide friction modifiers; amine-free friction modifiers, and organic, ashless, nitrogen-free friction modifiers.

Desirably, the titanium from a titanium compound is present in an amount of from about 10 ppm to about 1500 ppm, such as 10 ppm to 1000 ppm, more desirably from about 50 ppm to 500 ppm, and still more desirably in an amount of from about 75 ppm to about 250 ppm, based on the total weight of the lubricating composition. Because such titanium compounds may also provide antiwear credits to lubricating oil compositions, the use thereof allows for a reduction in the amount of metal dihydrocarbyl dithiophosphate antiwear agent (e.g., ZDDP) employed. Industry trends are leading to a reduction in the amount of ZDDP being added to lubricating oils to reduce the phosphorous content of the oil to below 1000 ppm, such as to 250 ppm to 750 ppm, or 250 ppm to 500 ppm. To provide adequate wear protection in such low phosphorous lubricating oil compositions, the titanium compound should be present in an amount providing at least 50 ppm by mass of titanium. The amount of titanium and/or zinc may be determined by Inductively Coupled Plasma (ICP) emission spectroscopy using the method described in ASTM D5185.

In a similar manner, the use of the titanium compounds in lubricating compositions may facilitate the reduction of antioxidant and extreme pressure agents in the lubricating compositions.

The oil soluble friction modifier that may be incorporated in the lubricating oil compositions described herein is a metal-free friction modifier. Accordingly, the friction modifier may be selected from nitrogen-containing, nitrogen-free and/or amine free friction modifiers. Typically, the friction modifier may be used in an amount ranging from about 0.02 to 2.0 wt. % of the total weight of the lubricating oil composition. Desirably, from 0.05 to 1.0, more desirably from 0.1 to 0.5, wt. % of the friction modifier is used.

Examples of such nitrogen containing friction modifiers that may be used include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, and the like.

Such friction modifiers may contain hydrocarbyl groups that may be selected from straight chain branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Suitable hydrocarbyl groups range from 12 to 25 carbon atoms and may be saturated or unsaturated. More desirable are those with linear hydrocarbyl groups.

Exemplary friction modifiers include amides of polyamines. Such compounds may have hydrocarbyl groups that are linear, either saturated or unsaturated or a mixture thereof and contain no more than about 12 to about 25 carbon atoms.

Other exemplary friction modifiers include alkoxylated amines and alkoxylated ether amines, with alkoxylated amines containing about two moles of alkylene oxide per mole of nitrogen being the most desirable. Such compounds can have hydrocarbyl groups that are linear, either saturated, unsaturated or a mixture thereof. They contain no more than about 12 to about 25 carbon atoms and may contain one or more hetero atoms in the hydrocarbyl chain. Ethoxylated amines and ethoxylated ether amines are particularly suitable nitrogen-containing friction modifiers. The amines and amides may be used as such or in the form of an adduct or reaction product with a boron compound such as a boric oxide, boron halide, metaborate, boric acid or a mono-, di- or tri-alkyl borate.

The ashless organic polysulfide compounds that may be used as friction modifiers include organic compounds expressed by the following formulae, such as sulfides of oils or fats or polyolefins, in which a sulfur atom group having two or more sulfur atoms adjoining and bonded together is present in a molecular structure.

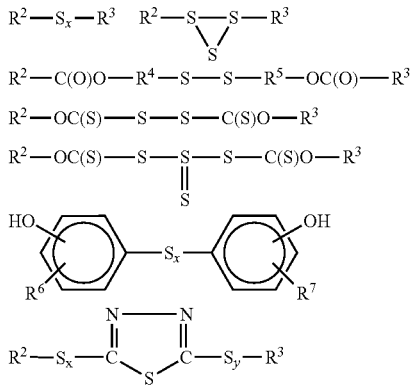

In the above formulae, $R^2$ and $R^3$ independently denote a straight-chain, branched-chain, alicyclic or aromatic hydrocarbon group in which a straight chain, a branched chain, an alicyclic unit and an aromatic unit may be selectively contained in any combined manner. An unsaturated bond may be contained, but a saturated hydrocarbon group is desirable. Among them, alkyl group, aryl group, alkylaryl group, benzyl group, and alkylbenzyl group are particularly desired.

$R^3$ and $R^4$ independently denote a straight-chain, branched-chain alicyclic or aromatic hydrocarbon group which has two bonding sites and in which a straight chain, a branched chain, an alicyclic unit and an aromatic unit may be selectively contained in any combined manner. An unsaturated bond may be contained, but a saturated hydrocarbon group is desirable. Among them, an alkylene group is particularly desirable.

$R^6$ and $K^7$ independently denote a straight-chain or branched-chain hydrocarbon group. The subscripts "x" and "y" denote independently an integer of two or more.

Specifically, for example, mention may be made of sulfurized sperm oil, sulfurized pinene oil, sulfurized soybean oil, sulfurized polyolefin, dialkyl disulfide, dialkyl polysulfide, dibenzyl disulfide, di-tertiary butyl disulfide, polyolefin polysulfide, thiadiazole type compound such as bis-alkyl polysulfanyl thiadiazole, and sulfurized phenol. Among these compounds, dialkyl polysulfide, dibenzyl disulfide, and thiadiazole type compound are desirable. Particularly desirable is bis-alkyl polysulfanyl thiadiazole.

The above ashless organic polysulfide compound (hereinafter referred to briefly as "polysulfide compound") is added in an amount of 0.01 to 0.4 wt %, typically 0.1-0.3 wt %, and desirably 0.2-0.3 wt %, when calculated as sulfur (S), relative to the total amount of the lubricant composition. If the addition amount is less than 0.01 wt %, it is difficult to attain the intended effect, whereas if it is more than 0.4 wt %, there is a danger that corrosive wear increase.

Organic, ashless (metal-free), nitrogen-free friction modifiers which may be used in the lubricating oil compositions disclosed herein are known generally and include esters formed by reacting carboxylic acids and anhydrides with alkanols or glycols, with fatty acids being particularly suitable carboxylic acids. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. A particularly desirable metal-free friction modifier to use in combination with the titanium compound and magnesium compound is an ester such as glycerol monooleate (GMO).

The friction modifier described above is included in the lubricating oil compositions disclosed herein an amount effective to allow the composition to reliably pass a high frequency reciprocating rig wear test (HFRR) in combination with the magnesium and titanium compounds. For example, the friction modifier may be added to the titanium-containing and magnesium-containing lubricating oil composition in an amount sufficient to obtain a average HFRR wear scar of less than about 130 square microns. Typically, to provide the desired effect, the friction modifier may be added in an amount of from about 0.25 wt. % to about 2.0 wt. % (AI), based on the total weight of the lubricating oil composition.

In the preparation of lubricating oil formulations it is common practice to introduce the additives in the form of 1 to 99 wt. % active ingredient concentrates in hydrocarbon oil, e.g. mineral lubricating oil, or other suitable solvent. Usually these concentrates may be added with 0.05 to 10 parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Lubricant compositions made with the hydrocarbon soluble titanium compound, the metal-free friction modifier, and the hydrocarbon soluble magnesium compound described above are used in a wide variety of applications. For compression ignition engines and spark ignition engines, it is desirable that the lubricant compositions meet or exceed published GF-4 or API-CI-4 standards. Lubricant compositions according to the foregoing GF-4 or API-CI-4 standards include a base oil and an oil additive package to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

Natural oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils used in the exemplary embodiments of the disclosure include one of any number of commonly used synthetic hydrocarbon oils, which include, but are not limited to, poly-alpha-olefins, alkylated aromatics, alkylene oxide polymers, interpolymers, copolymers and derivatives thereof here the terminal hydroxyl groups have been modified by esterification, etherification etc, esters of dicarboxylic acids and silicon-based oils.

Fully formulated lubricants conventionally contain an additive package, referred to herein as a dispersant/inhibitor package or DI package, that will supply the characteristics that are required in the formulations. Suitable DI packages are described for example in U.S. Pat. Nos. 5,204,012 and 6,034,040 for example. Among the types of additives included in the additive package may be dispersants, seal swell agents, antioxidants, foam inhibitors, lubricity agents, rust inhibitors, corrosion inhibitors, demulsifiers, viscosity index improvers, and the like. Several of these components are well known to those skilled in the art and are generally used in conventional amounts with the additives and compositions described herein.

Dispersants

Another component of lubricant compositions is at least one dispersant derived from a polyalkylene compound. The polyalkylene compound may have a number average molecular weight ranging from about 400 to about 5000 or more. Dispersants which may be used include, but are not limited to, amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

A particularly suitable dispersant is a polyalkylene succinimide dispersant derived from a polyisobutene (PIB) compound. The dispersant may be a mixture of dispersants having number average molecular weights ranging from about 800 to about 3000 and reactive PIB contents of from about 50 to about 60%. The total amount of dispersant in the lubricant composition may range from about 1 to about 10 percent by weight of the total weight of the lubricant composition.

Antiwear Agents

Metal dihydrocarbyl dithiophosphate antiwear agents may be added to the lubricating oil composition according to the exemplary embodiments in combination with the titanium compound, metal-free friction modifier, and magnesium compound. Such antiwear agents comprise dihydrocarbyl dithiophosphate metal salts wherein the metal may be an alkali or alkaline earth metal, or aluminum, lead, tin, molybdenum, manganese, nickel, copper, titanium, or zinc. The zinc salts are most commonly used in lubricating oils.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids may be prepared where the hydrocarbyl groups on one are entirely secondary in character and the hydrocarbyl groups on the others are entirely primary in character. To make the metal salt, any basic or neutral metal compound may be used but the oxides, hydroxides and carbonates are most generally used. Commercial additives frequently contain an excess of metal due to the use of an excess of the basic metal compound in the neutralization reaction.

The zinc dihydrocarbyl dithiophosphates (ZDDP) that are typically used are oil soluble salts of dihydrocarbyl dithiophosphoric acids and may be represented by the following formula:

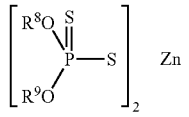

wherein $R^8$ and $R^9$ may be the same or different hydrocarbyl radicals containing from 1 to 18, typically 2 to 12, carbon atoms and including radicals such as alkyl, alkenyl, aryl, arylalkyl, alkaryl and cycloaliphatic radicals. Particularly desired as $R^8$ and $R^9$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^8$ and $R^9$) in the dithiophosphoric acid will generally be about 5 or greater. The zinc dihydrocarbyl dithiophosphate can therefore comprise zinc dialkyl dithiophosphates.

In order to limit the amount of phosphorus introduced into the lubricating oil composition by ZDDP to no more than 0.1 wt. % (1000 ppm), the ZDDP should desirably be added to the lubricating oil compositions in amounts no greater than from about 1.1 to 1.3 wt. %, based upon the total weight of the lubricating oil composition.

Other additives, such as the following, may also be present in lubricating oil compositions disclosed herein.

Viscosity Modifiers

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation Inhibitors

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having $C_5$ to $C_{12}$ alkyl side chains, calcium nonylphenol sulfide, ashless oil soluble phenates and sulfurized phenates, phosphosulfurized or sulfurized hydrocarbons, phosphorus esters, metal thiocarbamates and oil soluble copper compounds as described in U.S. Pat. No. 4,867,890.

Rust Inhibitors

Rust inhibitors selected from the group consisting of nonionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulations of the disclosed embodiments. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are typically present in an amount not exceeding 0.2 wt. % active ingredient.

Demulsifying Agent

A small amount of a demulsifying component may be used. A suitable demulsifying component is described in EP 330,522. The demulsifying component may be made by reacting an alkylene oxide with an adduct obtained by reacting a bis-epoxide with a polyhydric alcohol. The demulsifying component may be used at a level not exceeding 0.1 mass % active ingredient. A treat rate of 0.001 to 0.05 mass % active ingredient is convenient.

Pour Point Depressants

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Antifoam Agents

Foam control can be provided by many compounds including an antifoamant of the polysiloxane type, for example, silicone oil or polydimethyl siloxane.

Some of the above-mentioned additives may provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

The titanium compound, metal-free friction modifier, and magnesium compound additives may be added directly to the lubricating oil composition. In one embodiment, however, they are diluted with a substantially inert, normally liquid organic diluent such as mineral oil, synthetic oil, naphtha, alkylated (e.g. $C_{10}$-$C_{13}$ alkyl) benzene, toluene or xylene to form an additive concentrate. These concentrates usually contain from about 1% to about 100% by weight and in one embodiment about 10% to about 90% by weight of the titanium compound, metal-free friction modifier, and magnesium compounds.

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, and polysilicone oils. Natural base oils include mineral lubrication oils which may vary widely as to their crude source, e.g., as to whether they are paraffinic, naphthenic, or mixed paraffinic-naphthenic. The base oil typically has a viscosity of about 2.5 to about 15 cSt and desirably about 2.5 to about 11 cSt at 100° C.

Accordingly, the base oil used which may be used may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | <0.03 | And | >90 | 80 to 120 |
| Group III | <0.03 | And | >90 | >120 |
| Group IV | all polyalphaolefins (PAOs) | | | |
| Group V | all others not included in Groups I-IV | | | |

[1]Groups I-III are mineral oil base stocks.

The additives used in formulating the compositions described herein may be blended into the base oil individually or in various sub-combinations. However, it is desirable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The embodiments provide a lubricating oil for internal combustion engines in which the concentration of the added hydrocarbon soluble magnesium compound is relatively low, providing from about 120 to about 2000 parts per million (ppm) magnesium in terms of elemental magnesium in the oil. In one embodiment, the magnesium compound is present in the lubricating oil compositions in an amount sufficient to provide from about 250 to about 1500 ppm magnesium, and in a further embodiment from about 450 to about 1200 ppm magnesium metal.

Likewise embodiments of the disclosure provide a lubricating oil for internal combustion engines in which the concentration of added hydrocarbon soluble titanium compound is also relatively low, providing from about 10 to about 500 ppm titanium in terms of elemental titanium in the oil. More desirable amounts of titanium metal in the oil may range from about 50 to about 300 ppm.

The following example is given for the purpose of exemplifying aspects of the embodiments and is not intended to limit the embodiments in any way.

EXAMPLE

Four fully formulated lubricant compositions containing conventional additives were made with and without the magnesium, metal-free friction modifier, and/or titanium additives described above. Each of the lubricant compositions contained a conventional DI package providing about 9 percent by weight of the lubricant composition. The DI package contained conventional amounts of dispersants, antiwear additives, antifoam agents, and antioxidants as provided in Table 1 below. The conventional additives are typically blended into the base oil in an amount that enables that additive to provide its desired function. Representative effective amounts of the conventional additives, when used in crankcase lubricants with the titanium compound, metal-free friction modifier, and/or magnesium components, are listed in Table 1 below. All the values listed are stated as weight percent active ingredient.

TABLE 1

Conventional Additives

| Component | Wt. % (Broad) | Wt. % (Typical) |
|---|---|---|
| Dispersant | 0.5-5.0 | 1.0-4.5 |
| Antioxidant system | 0-5.0 | 0.01-3.0 |
| Corrosion inhibitor | 0-5.0 | 0-2.0 |
| Antiwear agent | 0.1-6.0 | 0.1-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |
| Viscosity modifier | 0.01-12.00 | 0.25-10.0 |
| Process oil | 0.1-10.0 | 0.5-5.0 |

The conventional additives of Table 1 were combined with the titanium compound, metal-free friction modifier, and/or magnesium additives to provide Oils B-D. Oil A is a conventional lubricant composition containing only the titanium compound. The fully formulated lubricant compositions are contained in Table 2. All amounts in the table are in terms of weight percent.

TABLE 2

Fully Formulated Lubricant Compositions

| Component, Wt % | Oil A | Oil B | Oil C | Oil D |
|---|---|---|---|---|
| Titanium Reastion Product of Example 1 - Antiwear | 0.24 | 0.24 | — | 0.24 |
| Magnesium Sulfonate - Detergent | — | 1.35 | 1.35 | 1.35 |
| Glycerol Monooleate - Antiwear | — | — | 0.35 | 0.35 |
| Conventional Additives - Table 1 | 16.31 | 16.31 | 16.31 | 16.31 |
| Group II Base Oil | 83.45 | 82.10 | 81.99 | 81.75 |
| Total | 100.0 | 100.0 | 100.0 | 100.0 |

Elemental analysis of the lubricant formulations provided in Table 2 are contained in the following Table 3. All amounts in Table 3 are in parts per million (ppm).

TABLE 3

Elemental Analysis

| Element | Oil A | Oil B | Oil C | Oil D |
|---|---|---|---|---|
| Phosphorus | 490 | 490 | 490 | 490 |
| Zinc | 540 | 540 | 540 | 540 |
| Magnesium | — | 1200 | 1200 | 1200 |
| Titanium | 150 | 150 | — | 150 |
| Boron | 240 | 240 | 240 | 240 |

The anti-wear properties of Oils A-D were determined in a High Frequency Reciprocating Wear Test Rig (HFRR). In the HFRR test, a steel ball immersed in the oil was oscillated across a steel disk at a speed of 20 Hz over a 1 mm path. A 7 Newton (~1.0 GPa) load was applied between the ball and the disk and tests were performed while holding the oil at 120° C. for one hour. After testing, a two-dimensional profile of the wear scar on the disk was determined. The cross-sectional area of the wear scar was reported and listed in Table 4 wherein the lower the value of the cross-sectional area, the better the anti-wear performance of the oil. The standard deviations for the wear scar measurements are also listed in Table 4.

TABLE 4

Wear Test Results

| HFRR Wear (700 g load, 120° C.) | Oil A | Oil B | Oil C | Oil D |
|---|---|---|---|---|
| Wear Scar, average $\mu m^2$ | 143 | 129 | 136 | 104 |
| Standard Deviation | 1 | 11 | 15 | 6 |

Oil D containing the magnesium additive, the metal-free friction modifier, and the titanium additive provided better wear scar data than the oils devoid of the titanium additive (Oil C), the magnesium additive (Oil A), and/or the metal-free friction modifier (Oils A and B) particularly at phosphorus levels of less than 500 ppm. It is also expected that the titanium additive, metal-free friction modifier, and magnesium additives described herein may be used to provide a phosphorus free lubricating oil composition. The foregoing example is not limited to formulations with Group II base oils. Benefits provided by the magnesium and titanium additives may also be evident in base oils selected from Group I, Group III, Group IV, Group V, and mixtures thereof.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricated surface comprising a lubricant composition containing a base oil of lubricating viscosity, a hydrocarbon soluble titanium compound, a metal-free friction modifier, and an amount of at least one hydrocarbon soluble magnesium compound effective to provide a reduction in surface wear greater than a reduction surface wear for a lubricant composition devoid of the titanium compound, metal-free friction modifier, and magnesium compound, wherein the lubricant composition contains no more than about 800 ppm phosphorus and is devoid of calcium detergents and organic molybdenum compounds, and wherein the hydrocarbon soluble titanium compound is derived from neodecanoic acid and titanium alkoxide.

2. The lubricated surface of claim 1, wherein the lubricated surface comprises an engine drive train.

3. The lubricated surface of claim 1, wherein the lubricated surface comprises an internal surface or component of an internal combustion engine.

4. The lubricated surface of claim 1, wherein the lubricated surface comprises an internal surface or component of a compression ignition engine.

5. The lubricated surface of claim 1, wherein the magnesium compound comprises magnesium sulfonate.

6. The lubricated surface of claim 5, wherein the magnesium sulfonate comprises an overabased sulfonate having a total base number (TBN) ranging from about 300 to about 500.

7. The lubricated surface of claim 1, wherein the titanium from a titanium compound is present in an amount of about 10 ppm to about 500 ppm.

8. The lubricated surface of claim 1, wherein a mole ratio of acid to alkoxide ranges from about 2:1 to about 4:1.

9. The lubricated surface of claim 1, wherein said titanium compound comprises a reaction product of titanium isopropoxide and neodecanoic acid.

10. The composition of claim 1, wherein said titanium compound comprises a compound substantially devoid of sulfur and phosphorus atoms.

11. The lubricated surface of claim 1, wherein the phosphorus content ranges from about 250 to about 500 ppm in the lubricant composition.

12. The lubricated surface of claim 1, wherein the metal-free friction modifier is selected from the group consisting of glycerol esters and amine compounds.

13. A motor vehicle comprising the lubricated surface of claim 1.

14. The lubricated surface of claim 1, wherein the amount of hydrocarbon soluble magnesium compound in the lubricant composition ranges from about 0.15 to about 2.0 percent by weight.

15. A vehicle having moving parts and containing a lubricant for lubricating the moving parts, the lubricant comprising an oil of lubricating viscosity and an amount of antiwear agent providing a combination of a hydrocarbon soluble titanium compound, a metal-free friction modifier, and at least one hydrocarbon soluble magnesium compound effective to provide a reduction in surface wear of the moving parts greater than a reduction surface wear of the moving parts for a lubricant composition devoid of the titanium compound, metal-free friction modifier, and magnesium compound, wherein the lubricant composition contains no more than about 800 ppm phosphorus and is devoid of calcium detergents and organic molybdenum compounds, and wherein the hydrocarbon soluble titanium compound is derived from neodecanoic acid and titanium alkoxide.

16. The vehicle of claim 15, wherein the magnesium compound comprises magnesium sulfonate.

17. The vehicle of claim 16, wherein the magnesium sulfonate comprises an overabased sulfonate having a total base number (TBN) ranging from about 300 to about 500.

18. The vehicle of claim 15, wherein the titanium from a titanium compound is present in an amount of about 10 ppm to about 500 ppm.

19. The vehicle of claim 15, wherein a mole ratio of acid to alkoxide ranges from about 2:1 to about 4:1.

20. The vehicle of claim 15, wherein the phosphorus content ranges from about 250 to about 500 ppm in the lubricant composition.

21. The vehicle of claim 15, wherein the metal-free friction modifier is selected from the group consisting of glycerol esters and amine compounds.

22. The vehicle of claim 15, wherein the moving parts comprise a heavy duty diesel engine.

23. A fully formulated lubricant composition comprising a base oil component of lubricating viscosity and an amount of antiwear agent provided by a combination of a hydrocarbon soluble titanium-containing compound, a metal-free friction modifier, and at least one hydrocarbon soluble magnesium compound effective to provide wear reduction greater than an amount of wear reduction for a lubricant composition devoid of the combination of titanium, metal-free friction modifier, and magnesium compounds, wherein the lubricant composition contains no more than about 800 ppm phosphorus and is devoid of calcium detergents and organic molybdenum compounds, and wherein the hydrocarbon soluble titanium-containing compound is derived from neodecanoic acid and titanium alkoxide.

24. The lubricant composition of claim 23 wherein the lubricant composition comprises a low ash, low sulfur, and low phosphorus lubricant composition suitable for compression ignition engines.

25. The lubricant composition of claim 23, wherein the magnesium compound comprises an overabased magnesium sulfonate having a total base number (TBN) ranging from about 300 to about 500.

26. The lubricant composition of claim 23, wherein the phosphorus content ranges from about 250 to about 500 ppm in the lubricant composition.

27. The lubricant composition of claim 23, wherein the metal-free friction modifier is selected from the group consisting of glycerol esters and amine compounds.

28. The lubricant composition of claim 23, wherein the amount of magnesium compound in the lubricant composition ranges from about 0.15 to about 2.0 percent by weight.

29. The lubricant composition of claim 23, wherein the titanium-containing from a titanium compound is present in an amount of about 10 ppm to about 500 ppm.

30. The lubricant composition of claim 29, wherein a mole ratio of acid to alkoxide ranges from about 2:1 to about 4:1.

31. A lubricant additive concentrate for providing improved antiwear properties to a lubricant composition, the concentrate begin devoid of calcium and molybdenum and comprising a hydrocarbyl carrier fluid and a synergistic amount of a combination of a hydrocarbon soluble titanium compound, glycerol monooleate, and a hydrocarbon soluble magnesium compound sufficient to provide from about 10 to about 500 ppm titanium and from about 120 to about 2000 ppm magnesium to a lubricant composition containing the concentrate, wherein the hydrocarbon soluble titanium compound is derived from neodecanoic acid and titanium alkoxide.

32. The additive concentrate of claim 31, wherein the magnesium compound comprises an overbased magnesium sulfonate having a total base number (TBN) ranging from about 300 to about 500.

33. The additive concentration of claim 31, wherein the titanium from a titanium compound is present in an amount of about 10 ppm to about 500 ppm.

34. The additive concentrate of claim 31, wherein a mole ratio of acid to alkoxide ranges from about 2:1 to about 4:1.

35. A lubricant composition comprising a base oil and the additive concentrate of claim 31.

36. A method of lubricating moving parts with a lubricating oil exhibiting increased antiwear properties, the method comprising using as the lubricating oil for one or more moving parts a lubricant composition containing a base oil and an antiwear additive combination substantially devoid of calcium, the antiwear additive combination comprising a hydrocarbyl carrier fluid, a hydrocarbon soluble titanium compound, a metal-free friction modifier, and a hydrocarbon soluble magnesium compound sufficient to provide from about 10 to about 500 ppm titanium and from about 120 to about 2000 parts per million magnesium in the lubricating oil, wherein the hydrocarbon soluble titanium compound is derived from neodecanoic acid and titanium alkoxide, wherein a mole ratio of acid to alkoxide ranges from about 2:1 to about 4:1.

37. The method of claim 36, wherein the moving parts comprise moving parts of an engine.

38. The method of claim 37, wherein the engine is selected from the group consisting of a compression ignition engine and a spark ignition engine.

39. The method of claim 37, wherein the engine includes an internal combustion engine having a crankcase and wherein the lubricating oil comprises a crankcase oil present in the crankcase of the engine.

40. The method of claim 36, wherein the lubricating oil comprises a drive train lubricant present in a drive train of a vehicle containing an engine.

41. The method of claim 36, wherein the metal-free friction modifier is selected from the group consisting of glycerol esters and amine compounds.

* * * * *